US008479808B2

(12) United States Patent
Gouthaman

(10) Patent No.: US 8,479,808 B2
(45) Date of Patent: Jul. 9, 2013

(54) DOWNHOLE TOOLS HAVING RADIALLY EXPANDABLE SEAT MEMBER

(75) Inventor: Varun Gouthaman, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 288 days.

(21) Appl. No.: 13/150,422

(22) Filed: Jun. 1, 2011

(65) Prior Publication Data

US 2012/0305236 A1 Dec. 6, 2012

(51) Int. Cl.
*E21B 34/10* (2006.01)

(52) U.S. Cl.
USPC ..... 166/156; 166/317

(58) Field of Classification Search
USPC ..... 166/153, 156, 193, 194, 317, 318
See application file for complete search history.

(56) References Cited

U.S. PATENT DOCUMENTS

| | | | |
|---|---|---|---|
| 1,883,071 | A | 10/1932 | Stone |
| 2,117,539 | A | 5/1938 | Baker et al. |
| 2,769,454 | A | 11/1956 | Bletcher et al. |
| 2,822,757 | A | 2/1958 | Coberly |
| 2,829,719 | A | 4/1958 | Clark, Jr. |
| 2,857,972 | A | 10/1958 | Baker et al. |
| 2,973,006 | A | 2/1961 | Nelson |
| 3,007,527 | A | 11/1961 | Nelson |
| 3,013,612 | A | 12/1961 | Angel |
| 3,043,903 | A | 7/1962 | Keane et al. |
| 3,090,442 | A | 5/1963 | Cochran et al. |
| 3,211,232 | A | 10/1965 | Grimmer |
| 3,220,481 | A | 11/1965 | Park |
| 3,220,491 | A | 11/1965 | Mohr |
| 3,510,103 | A | 5/1970 | Carsello |
| 3,566,964 | A | 3/1971 | Livingston |
| 3,667,505 | A | 6/1972 | Radig |

(Continued)

FOREIGN PATENT DOCUMENTS

| | | | |
|---|---|---|---|
| CA | 2460712 | | 4/2005 |
| EP | 0518371 | A3 | 12/1992 |
| WO | WO/02 068793 | A1 | 9/2002 |
| WO | WO 03006787 | A1 | 1/2003 |

OTHER PUBLICATIONS

D.W. Thomson, et al., Design and Installation of a Cost-Effective Completion System for Horizontal Chalk Wells Where Multiple Zones Require Acid Stimulation, Spe Drilling & Completion, Sep. 1998, pp. 151-156, Offshore Technology Conference, U.S.A.

(Continued)

*Primary Examiner* — William P Neuder
(74) *Attorney, Agent, or Firm* — Greenberg Traurig LLP; Anthony F. Matheny

(57) ABSTRACT

Apparatuses for restricting fluid flow through a well conduit comprise a tubular member having a radially expandable seat member disposed within the tubular member. The radially expandable seat member comprises one or more arcuate members, each having first and second ends. The radially expandable seat member comprises a first position in which the first and second ends are disposed relative to each other to provide a first inner diameter opening through the radially expandable seat member for receiving a plug element, and a second position in which the first and second ends are moved radially outward relative to one another to provide a second inner diameter opening through the radially expandable seat member, the second inner diameter being greater than the first inner diameter thereby facilitating the plug element passing through the radially expandable seat member.

22 Claims, 8 Drawing Sheets

U.S. PATENT DOCUMENTS 3,727,635 A 4/1973 Todd
3,776,258 A 12/1973 Dockins, Jr.
3,901,315 A 8/1975 Parker et al.
4,114,694 A 9/1978 Dinning
4,160,478 A 7/1979 Calhoun et al.
1,194,156 A 3/1980 Maly
4,291,722 A 9/1981 Churchman
4,292,988 A 10/1981 Montgomery
4,314,608 A 2/1982 Richardson
4,374,543 A 2/1983 Richardson
4,390,065 A 6/1983 Richardson
4,448,216 A 5/1984 Speegle et al.
4,478,279 A 10/1984 Puntar et al.
4,510,994 A * 4/1985 Pringle ..... 166/156
4,520,870 A 6/1985 Pringle
4,537,255 A 8/1985 Regalbuto et al.
4,537,383 A 8/1985 Fredd
4,576,234 A 3/1986 Upchurch
4,583,593 A 4/1986 Zunkel et al.
4,669,538 A 6/1987 Szarka
4,729,432 A 3/1988 Helms
4,823,882 A 4/1989 Stokley et al.
4,826,135 A 5/1989 Mielke
4,828,037 A 5/1989 Lindsey et al.
4,848,691 A 7/1989 Muto et al.
4,862,966 A 9/1989 Lindsey et al.
4,893,678 A 1/1990 Stokley et al.
4,915,172 A 4/1990 Donovan et al.
4,949,788 A 8/1990 Szarka et al.
4,991,654 A 2/1991 Brandell et al.
5,056,599 A 10/1991 Comeaux et al.
5,146,992 A 9/1992 Baugh
5,244,044 A 9/1993 Henderson
5,246,203 A 9/1993 McKnight et al.
5,297,580 A 3/1994 Thurman
5,309,995 A 5/1994 Gonzalez et al.
5,333,689 A 8/1994 Jones et al.
5,333,692 A 8/1994 Baugh et al.
5,335,727 A 8/1994 Cornette et al.
5,413,180 A 5/1995 Ross et al.
5,479,986 A 1/1996 Gano et al.
5,501,276 A 3/1996 Weaver et al.
5,511,620 A 4/1996 Baugh et al.
5,558,153 A 9/1996 Holcombe et al.
5,577,560 A 11/1996 Coronado et al.
5,607,017 A 3/1997 Owens et al.
5,623,993 A 4/1997 Van Buskirk et al.
5,685,372 A 11/1997 Gano
5,704,393 A 1/1998 Connell et al.
5,709,269 A 1/1998 Head
5,762,142 A 6/1998 Connell et al.
5,765,641 A 6/1998 Shy et al.
5,813,483 A 9/1998 Latham et al.
5,960,881 A 10/1999 Allamon et al.
5,992,289 A 11/1999 George et al.
6,003,607 A 12/1999 Hagen et al.
6,026,903 A 2/2000 Shy et al.
6,050,340 A 4/2000 Scott
6,053,248 A 4/2000 Ross
6,053,250 A 4/2000 Echols
6,062,310 A 5/2000 Wesson et al.
6,076,600 A 6/2000 Vick, Jr. et al.
6,079,496 A 6/2000 Hirth
6,102,060 A 8/2000 Howlett et al.
6,155,350 A 12/2000 Melenyzer
6,161,622 A 12/2000 Robb et al.
6,189,618 B1 2/2001 Beeman et al.
6,220,350 B1 4/2001 Brothers et al.
6,279,656 B1 8/2001 Sinclair et al.
6,289,991 B1 9/2001 French
6,293,517 B1 9/2001 Cunningham
6,382,234 B1 5/2002 Birckhead et al.
6,397,950 B1 6/2002 Streich et al.
6,431,276 B1 8/2002 Robb et al.
6,457,517 B1 10/2002 Goodson et al.
6,467,546 B2 10/2002 Allamon et al.
6,530,574 B1 3/2003 Bailey et al.
6,547,007 B2 4/2003 Szarka et al.
6,634,428 B2 10/2003 Krauss et al.
6,666,273 B2 12/2003 Laurel
6,668,933 B2 12/2003 Kent
6,708,946 B1 3/2004 Edwards et al.
6,779,600 B2 8/2004 King et al.
6,834,726 B2 12/2004 Giroux et al.
6,848,511 B1 2/2005 Jones et al.
6,866,100 B2 3/2005 Gudmestad et al.
6,896,049 B2 5/2005 Moyes
6,926,086 B2 8/2005 Patterson et al.
6,966,368 B2 11/2005 Farquhar
7,021,389 B2 4/2006 Bishop et al.
7,093,664 B2 8/2006 Todd et al.
7,150,326 B2 12/2006 Bishop et al.
7,311,118 B2 12/2007 Doutt
7,325,617 B2 2/2008 Murray
7,350,582 B2 4/2008 McKeachnie et al.
7,353,879 B2 4/2008 Todd et al.
7,395,856 B2 7/2008 Murray
7,416,029 B2 8/2008 Telfer et al.
7,464,764 B2 12/2008 Xu
7,469,744 B2 12/2008 Ruddock et al.
7,503,392 B2 3/2009 King et al.
7,625,846 B2 12/2009 Cooke, Jr.
7,628,210 B2 12/2009 Avant et al.
7,640,991 B2 1/2010 Leising
7,644,772 B2 1/2010 Avant et al.
8,276,675 B2 * 10/2012 Williamson et al. ..... 166/383
2002/0162661 A1 11/2002 Krauss et al.
2003/0037921 A1 2/2003 Goodson
2003/0141064 A1 7/2003 Roberson, Jr.
2003/0168214 A1 9/2003 Sollesnes
2004/0108109 A1 6/2004 Allamon et al.
2005/0061372 A1 3/2005 McGrath et al.
2005/0092363 A1 5/2005 Richard et al.
2005/0092484 A1 5/2005 Evans
2005/0126638 A1 6/2005 Gilbert
2005/0161224 A1 7/2005 Starr et al.
2005/0205264 A1 9/2005 Starr et al.
2005/0205265 A1 9/2005 Todd et al.
2005/0205266 A1 9/2005 Todd et al.
2005/0281968 A1 12/2005 Shanholtz et al.
2006/0021748 A1 2/2006 Swor et al.
2006/0131031 A1 6/2006 McKeachnie et al.
2006/0175092 A1 8/2006 Mashburn
2006/0213670 A1 9/2006 Bishop et al.
2006/0243455 A1 11/2006 Telfer et al.
2006/0266518 A1 11/2006 Woloson
2007/0023087 A1 2/2007 Krebs et al.
2007/0029080 A1 2/2007 Moyes
2007/0062706 A1 3/2007 Leising
2007/0074873 A1 4/2007 McKeachnie et al.
2007/0169935 A1 7/2007 Akbar et al.
2007/0295507 A1 12/2007 Telfer
2008/0017375 A1 1/2008 Wardley
2008/0066923 A1 3/2008 Xu
2008/0066924 A1 3/2008 Xu
2008/0217025 A1 9/2008 Ruddock et al.
2009/0025927 A1 1/2009 Telfer
2009/0044946 A1 2/2009 Schasteen et al.
2009/0044948 A1 2/2009 Avant et al.
2009/0044949 A1 2/2009 King et al.
2009/0044955 A1 2/2009 King et al.
2009/0107684 A1 4/2009 Cooke, Jr.
2010/0032151 A1 2/2010 Duphorne
2010/0132954 A1 6/2010 Telfer
2011/0187062 A1 8/2011 Xu
2011/0192607 A1 * 8/2011 Hofman et al. ..... 166/317
2011/0315390 A1 12/2011 Guillory et al.
2012/0012771 A1 1/2012 Korkmaz et al.
2012/0048556 A1 3/2012 O'Connell et al.
2012/0199341 A1 8/2012 Kellner et al.
2012/0227980 A1 9/2012 Fay
2012/0261115 A1 10/2012 Xu

OTHER PUBLICATIONS

H.A. Nasr-El-Din, et al., Laboratory Evaluation Biosealers, Feb. 13, 2001, pp. 1-11, SPE 65017, Society of Petroleum Engineers Inc., U.S.A.

Baker Hughes Incorporated. Model "E" Hydro-Trip Pressure Sub, Product Family No. H79928, Sep. 25, 2003, pp. 1-4, Baker Hughes Incorporated, Houston, Texas USA.
Innicor Completion Systems, HydroTrip Plug Sub, Product No. 658-0000, Jul. 26, 2004, p. 1, Innicor Completion Systems, Canada.
K.L. Smith, et al., "Ultra-Deepwater Production Systems Technical Progress Report," U.S. Department of Energy, Science and Technical Information, Annual Technical Progress Report, Jan. 2005, pp. 1-32, ConocoPhillips Company, U.S.A.
X. Li, et al., An Integrated Transport Model for BallSealer Diversion in Vertical and Horizontal Wells, Oct. 9, 2005, pp. 1-9, SPE 96339, Society of Petroleum Engineers, U.S.A.
G.L. Rytlewski, A Study of Fracture Initiation Pressures in Cemented Cased Hole Wells Without Perforations, May 15, 2006, pp. 1-10, SPE 100572, Society of Petroleum Engineers, U.S.A.
StageFRAC Maximize Reservoir Drainage, 2007, pp. 1-2, Schlumberger, U.S.A.
Brad Musgrove, Multi-Layer Fracturing Solution Treat and Produce Completions, Nov. 12, 2007, pp. 1-23, Schlumberger, U.S.A.

* cited by examiner

DOWNHOLE TOOLS HAVING RADIALLY EXPANDABLE SEAT MEMBER

BACKGROUND

1. Field of Invention

The present invention is directed to ball seats for use in oil and gas wells and, in particular, to ball seats having a radially expandable seat that, when in one position provides a seal for a ball disposed on the seat and, when in a second position, allows the ball to pass through the seat.

2. Description of Art

Ball seats are generally known in the art. For example, typical ball seats have a bore or passageway that is restricted by a seat. The ball or plug element is disposed on the seat, preventing or restricting fluid from flowing through the bore of the ball seat and, thus, isolating the tubing or conduit section in which the ball seat is disposed. As force is applied to the ball or plug element, the conduit can be pressurized for tubing testing or tool actuation or manipulation, such as in setting a packer. Ball seats are also used in cased hole completions, liner hangers, flow diverters, frac systems, and flow control equipment and systems.

Although the terms "ball seat" and "ball" are used herein, it is to be understood that a drop plug or other shaped plugging device or element may be used with the "ball seats" disclosed and discussed herein. For simplicity it is to be understood that the terms "ball" and "plug element" include and encompass all shapes and sizes of plugs, balls, darts, or drop plugs unless the specific shape or design of the "ball" is expressly discussed.

SUMMARY OF INVENTION

Broadly, the ball seats disclosed herein comprise having a housing and a radially expandable seat member disposed therein. The radially expandable seat comprises a first or collapsed position and a second or expanded position. A ball or plug element is disposed on the radially expandable seat member when the seat member is in the first or collapsed position to block or restrict flow through the housing. In one embodiment, after the pressure forcing the ball into the seat reaches a predetermined level, a retaining member retaining the expandable seat member in collapsed position is actuated and the seat member radially expands to the second or expanded position. The second position provides an inner diameter opening that is greater than an inner diameter opening of the seat member in its first position. Thus, the ball can pass through the seat member.

In general, the radially expandable seat member comprises first and second ends that are disposed close to one another when in the first position. In one specific embodiment, first and second ends of radially expandable seat member contact and overlap each other when in the first position and are moved radially away from each other when in the second position. Movement of the first end and second end away from each other causes the inner diameter opening through the radially expandable seat member to increase so that the plug element can be passed through the radially expandable seat member.

In other embodiments, the first and second ends of radially expandable seat member do not overlap each other, but are in contact with each other. In certain other embodiments, the first and second ends of radially expandable seat member do not contact each other and, therefore a gap is disposed between the first and second ends. In still other embodiments, the point at which first and second ends come together, whether in contact, not in contact, overlapping, or not overlapping, a bonding material can be disposed over the connection to reduce leakage through the radially expandable seat member.

In still other embodiments, the radially expandable seat member comprises two or more arcuate segments that are connected together by retaining members that, at a predetermined pressure acting on them, fail so that the radially expandable seat member can expand to the second position. To prevent the one or more of the arcuate segments from falling into the wellbore, a locking or retaining mechanism can be operatively associated with one or more of the arcuate segments.

In certain embodiments, the radially expandable seat member is disposed in a recess disposed on an inner wall surface of a tubular member. In other embodiments, the recess is formed from the mating of an upper sub to a lower sub.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
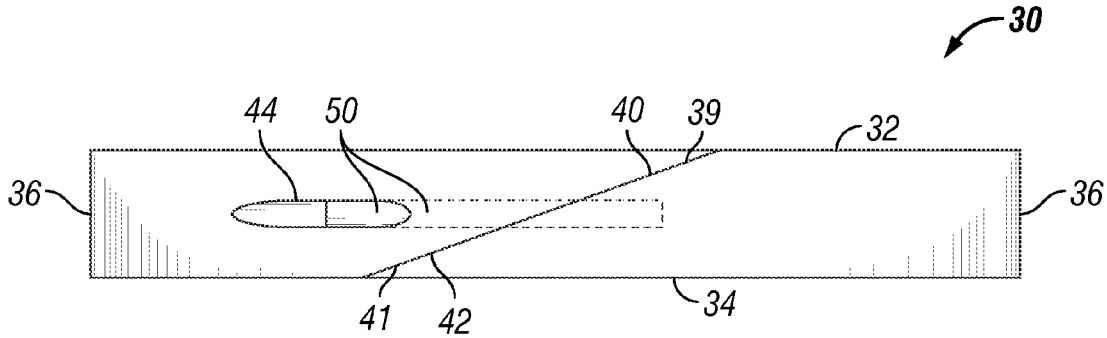
FIG. 1 is a side view of a specific embodiment of a radially expandable seat member shown in the first or collapsed position.
Figure 2:
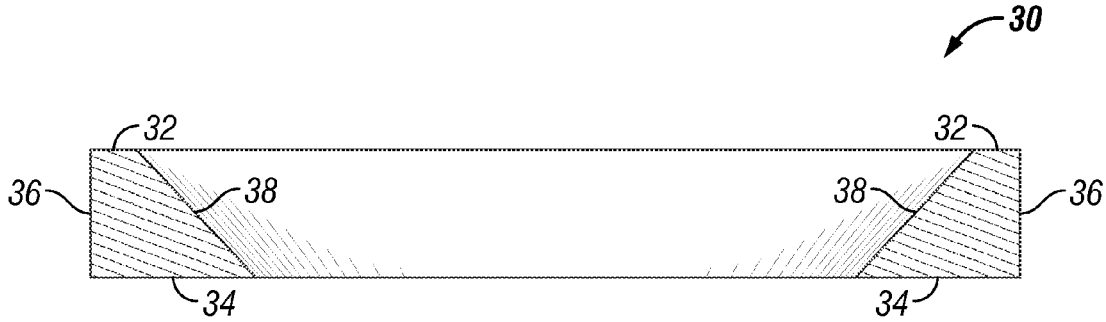
FIG. 2 is a partial cross-sectional view of the radially expandable seat member shown in FIG. 1.
Figure 3:
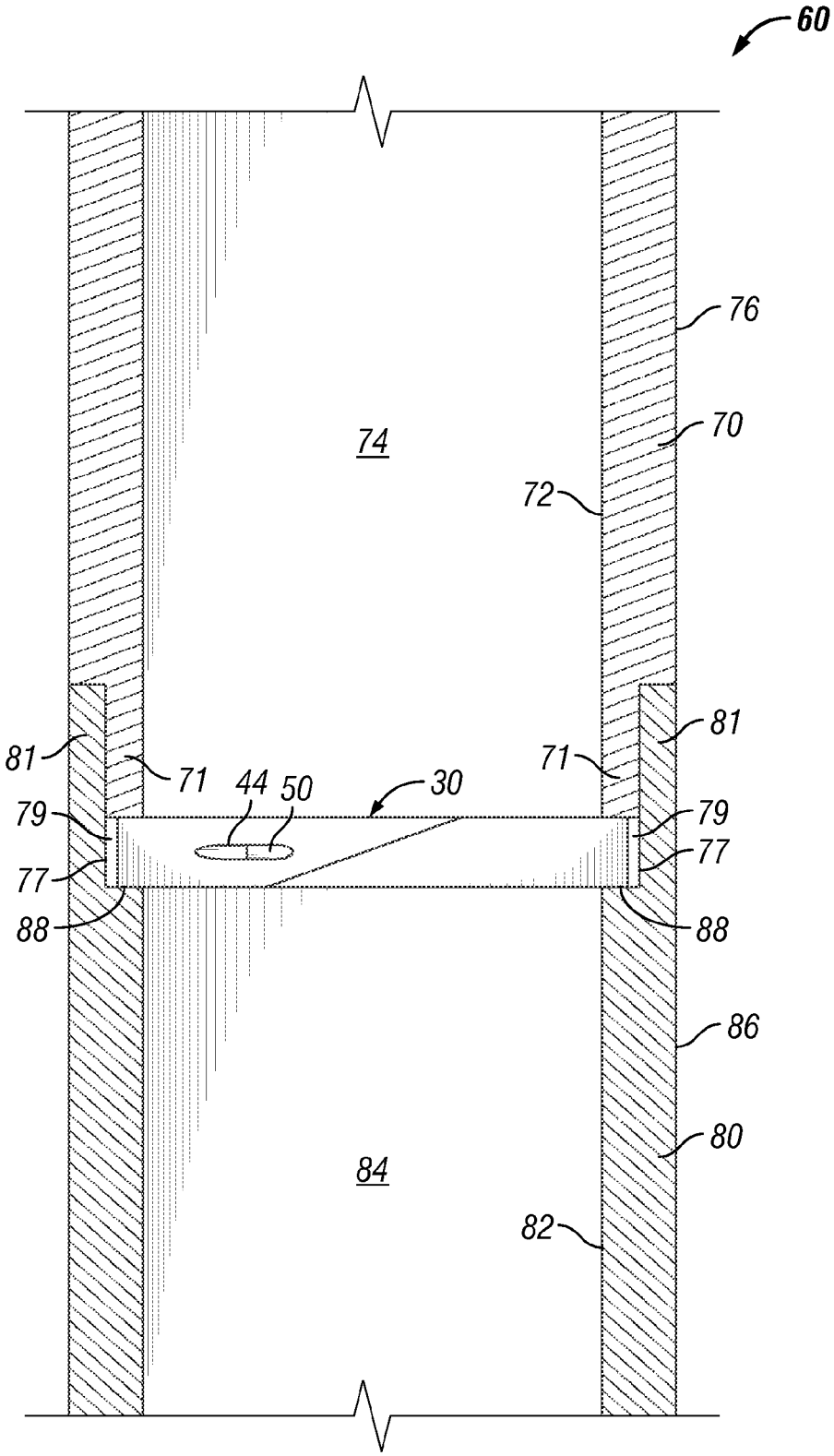
FIG. 3 is a partial cross-sectional view of a ball seat having the radially expandable seat member of FIG. 1 disposed therein, the radially expandable seat member shown in the first or collapsed position.
Figure 4:
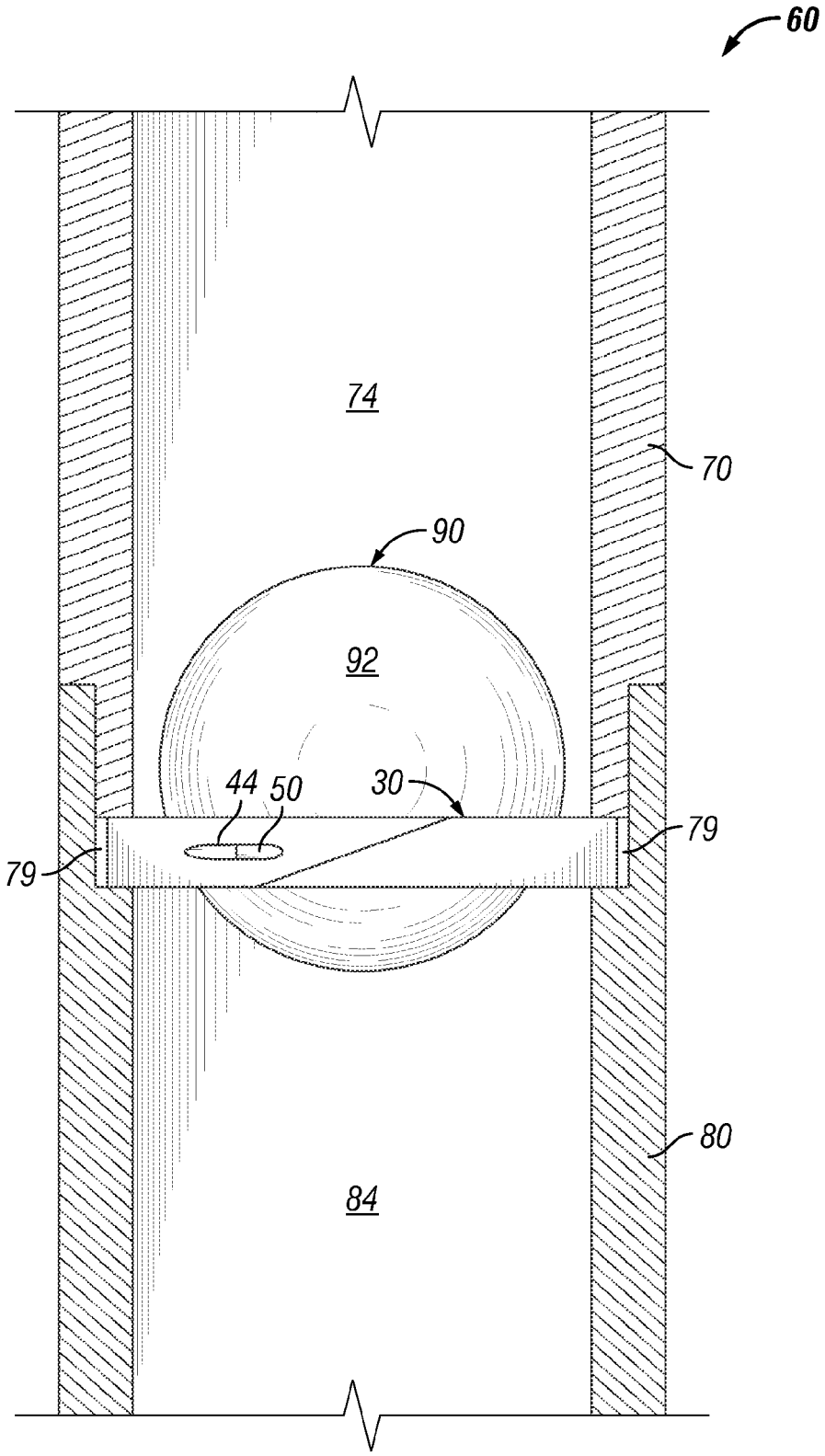
FIG. 4 is a partial cross-sectional view of a ball seat having the radially expandable seat member of FIG. 1 disposed therein, the radially expandable seat member shown in the first or collapsed position with a ball landed thereon.

Referring now to FIGS. 1-5, in one embodiment radially expandable seat member 30 comprises upper surface 32, lower surface 34, outer wall surface 36, seat 38, first end 39, and second end 41. First end 39 and second end 41 can have any shape desired or necessary to facilitate first and second ends 39, 41 respectively to be placed in the collapsed position (FIG. 1) to receive a plug element so that a sufficient seal can be established between upper surface 32 and a plug element (not shown). As shown in FIGS. 1 and 3-5, first end 39 and second end 41 are shaped so that they contact and overlap one another when radially expandable seat member 30 is in the collapsed position (FIGS. 1 and 3-4). Further, in the embodiments shown in FIGS. 1-5, first end 39 and second end 41 have shapes that are reciprocal to each other.

As shown in the embodiment of FIGS. 1-5, first end 39 is angled along incline 40 and second end 41 is angled along incline 42, wherein incline 40 and incline 42 overlap and engage one another when in the first position. Angled inclines 40, 42 can be in the range from approximately 10 degrees to approximately 80 degrees. In one particular embodiment, angled inclines 40, 42 are each 45 degrees.

The first or collapsed position of radially expandable seat member 30 provides a first or collapsed inner diameter opening. In the first or collapsed position, a plug element such as a ball can be landed on upper surface 32 of radially expandable seat member 30 to facilitate blocking fluid flow through radially expandable seat member 30 and, thus, through the bore of the apparatus containing radially expandable seat member 30. It is to be understood, however, that a complete seal of fluid flow through radially expandable seat member 30 is not required as downhole operations such as actuation of downhole tools can be accomplished without attaining a complete leak-proof seal.

Figure 5:
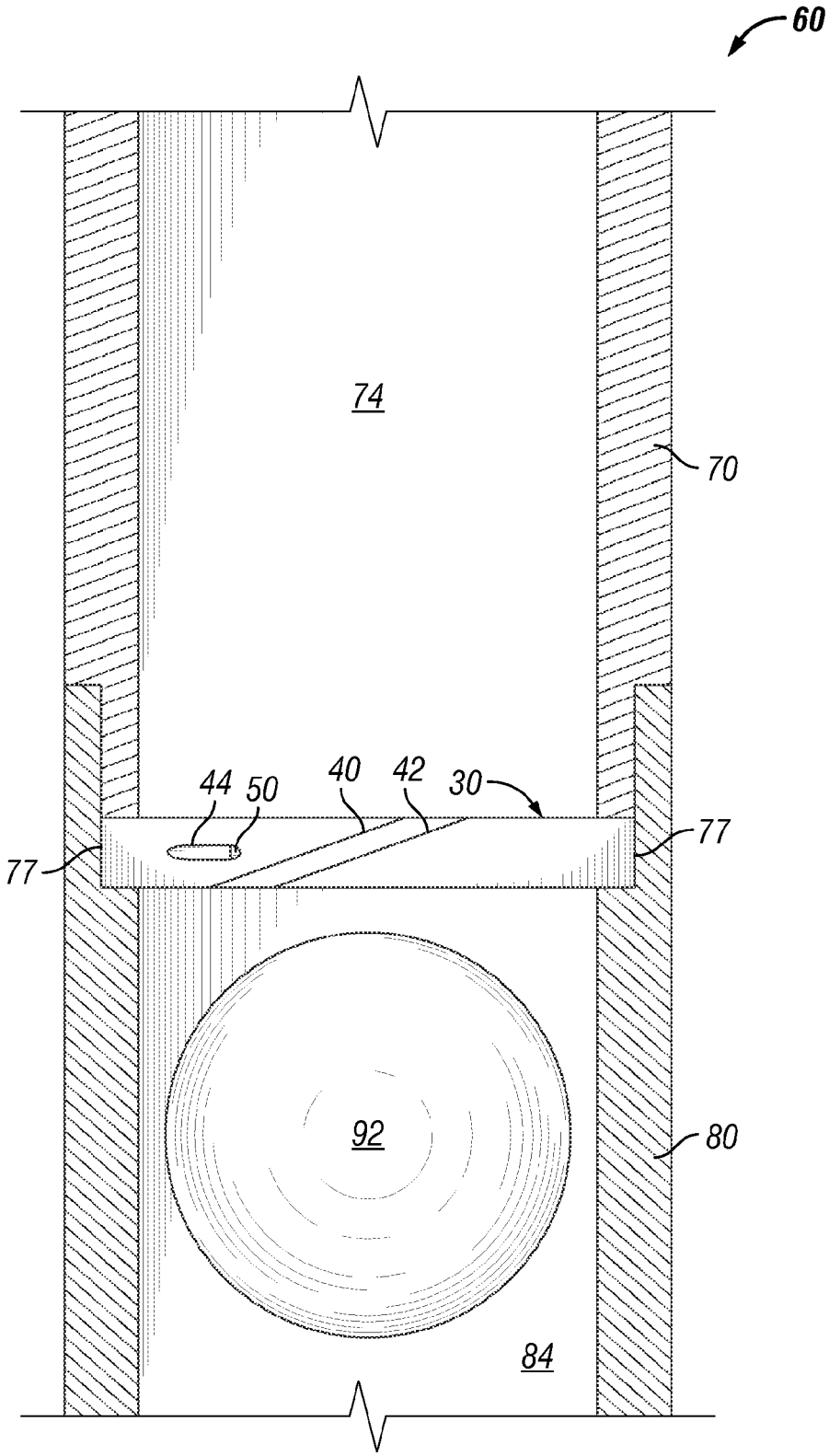
FIG. 5 is a cross-sectional view of a ball seat having the radially expandable seat member of FIG. 1 disposed therein, the radially expandable seat member shown in the second or expanded position.

As shown in FIG. 5, the second or expanded position of radially expandable seat member 30 comprises first end 39 and second end 41 being moved radially outward away from each other to provide a second or expanded inner diameter opening. In the second or expanded position, a plug element such as a ball can pass through, either due gravity or with the assistance of pressure acting downward on the plug element so that fluid flow can be reestablished through radially expandable seat member 30.

Radially expandable seat member 30 may be formed out of any material desired or necessary to provide a sufficient seal between a plug element and radially expandable seat member 30 and to allow radially expandable seat member 30 to move from its collapsed position to its expanded position. For example, radially expandable seat member 30 may be formed by polyether ether ketone (PEEK), polytetrafluoroethylene (PTFE), rubber, elastomer, metal, reinforced metal, or a combination of any of these materials.

In one embodiment, radially expandable seat member 30 is biased or energized toward the expandable position (FIG. 5) when disposed in the first or collapsed position (FIGS. 1 and 3-4). Thus, when placed in the position shown in FIGS. 1, 3, and 4, first end 39 and second end 41 are trying to move away from each other. One example of such a biased radially expandable seat member is a c-ring. Thus, to retain radially expandable seat member 30 in the first or collapsed position so that it can receive a ball on seat 38, a retaining member is disposed at first and second ends 39, 41 to retain radially expandable seat member 30 in the first or collapsed position. In the embodiment of FIGS. 1-5, the retaining member comprises shear screw 50 that is disposed within recess 44 disposed in outer wall surface 36 and through the body of radially expandable seat member 30 through first end 39 and second end 41.

Referring now to FIGS. 3-5, ball seat 60 comprises upper sub 70 and lower sub 80. Upper sub 70 can be secured to lower sub 80 through any method or device known in the art. For example, threads (not shown) may be disposed at lower end 71 of upper sub 70 and upper end 81 of lower sub 80.

Upper sub 70 comprises outer wall surface 76 and inner wall surface 72 defining upper sub bore 74. Lower sub 80 comprises outer wall surface 86 and inner wall surface 82 defining lower sub bore 84. Lower sub 80 includes shoulder 88 disposed toward upper end 81. Lower end 71 of upper sub 70 and shoulder 88 of lower sub 80 provide recess 77 when upper sub 70 is made-up with lower sub 80. Although recess 77 is shown as being formed by the mating of upper sub 70 to lower sub 80, it is to be understood that recess 77 can be a groove cut into inner wall surface 72 or inner wall surface 82. As shown in FIG. 3, radially expandable seat member 30 is disposed in, and in sliding engagement with one or more surfaces of, recess 77. Because radially expandable seat member 30 is in its first or collapsed position as shown in FIG. 1, gap 79 is disposed between outer wall surface 36 of radially expandable seat member 30 and inner wall surface 82 of lower sub 80.

Attachment members (not shown) such as threads can be disposed along the outer wall surfaces 76, 86 of upper and lower subs 70, 80 at the upper and lower ends respectively for securing ball seat 60 into a string of conduit, such as drill pipe or tubing string. Alternatively, attachment members such as threads can be disposed along inner wall surfaces 72, 82 of upper and lower subs 70, 80 at the upper and lower ends respectively for securing ball seat 60 into a string of conduit.

In operation, ball seat 60 is secured to a work or tubing string (not shown) and lowered into the wellbore (not shown). A downhole tool (not shown) is disposed in the work string above ball seat 60. During run-in, radially expandable seat member 30 is disposed recess 77 of ball seat 60 in the first or collapsed position (FIGS. 3-4). After being disposed within the wellbore at the desired depth or location, plug element 90 shown as ball 92 is dropped down the tubing string until it enters upper sub bore 74 and lands on seat 38 of radially expandable seat member 30 (FIG. 4).

Fluid, such as hydraulic fluid, is pumped down the tubing string causing downward force or pressure to act on ball 92 to force ball 92 into seat 38. The fluid pressure is then increased above ball 92 until it reaches the actuation pressure of the downhole tool causing the downhole tool to perform its intended function, e.g., set a packer, set a bridge plug and the like. This actuation pressure is a preset pressure that is below the pressure at which the retaining member, shown as shear screw 50, reaches its failure or breakage point.

After the downhole tool has performed its intended function, additional fluid pressure can be exerted on ball 92 to force ball 92 further into radially expandable seat member 30 so that the retaining member, shown as shear screw 50, fails. After failure of shear screw 50, radially expandable seat member 30 moves to the expanded position (FIG. 5) because, in this embodiment, radially expandable seat member 30 is biased radially outwardly and the shear screw 50 is no longer retaining radially expandable seat member 30 in the first or collapsed position.

As shown in FIG. 5, in moving toward the second or expanded position, the inner diameter of radially expandable seat member 30 is increased to the second inner diameter opening which facilitates passage of ball 92 through radially expandable seat member 30 as shown in FIG. 5. In the embodiment of FIGS. 1-5, radially expandable seat member 30 is radially expanded until outer wall surface 36 of radially expandable seat member 30 engages inner wall surface 82 within recess 77. In other words, radially expandable seat member 30 fills gap 79. As a result, the inner diameter of the opening through radially expandable seat member 30 is increased such that ball 92 passes through radially expandable seat member 30 either due to gravity or the continued force of pressure within upper sub bore 74 acting downwardly on ball 92. It is to be understood, however, that gap 79 does not have to be completed filled when radially expandable seat member 30 is in the second position.

Although the embodiment of FIGS. 1-5 shows the ball seat 60 and radially expandable seat member 30 as sharing the same axis, it is to be understood that radially expandable seat member 30 and ball seat 60 are not required to share the same axis. Instead, as radially expandable seat member 30 expands, its axis may be off-center from the axis of ball seat 60, yet plug element 90 will still pass through radially expandable seat member 30 when in the second position.

Figure 6:
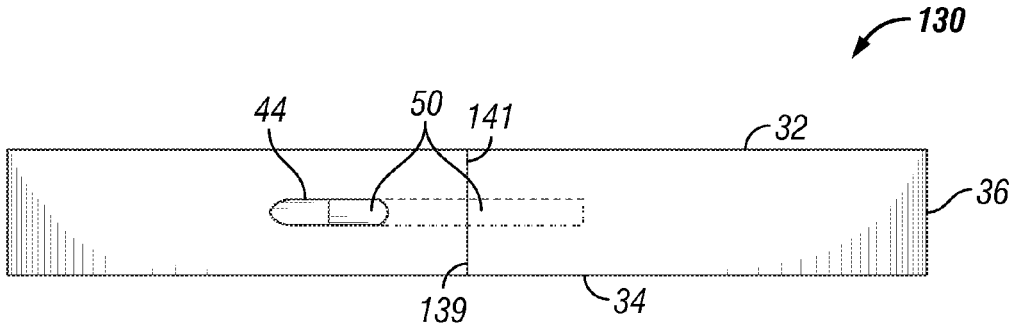
FIG. 6 is a side view of another specific embodiment of a radially expandable seat member shown in the first or collapsed position.

In the embodiment of FIGS. 1-5, inclines 40, 42 facilitate radial expansion of radially expandable seat member 30 due to the downward pressure being exerted on radially expandable seat member 30 by ball 92. However, it is to be understood that inclines 40, 42 are not required to be disposed along first end 39 and second end 41, respectively. To the contrary, as shown in FIG. 6, radially expandable seat member 130 may comprise first end 139 and second end 141 lacking inclines 140, 142, respectively. Instead, first end 139 and second end 141 are disposed in contact with each other along a substantially vertical line as shown in FIG. 6 when radially expandable seat member 130 is in the first or collapsed position.

Figure 7:
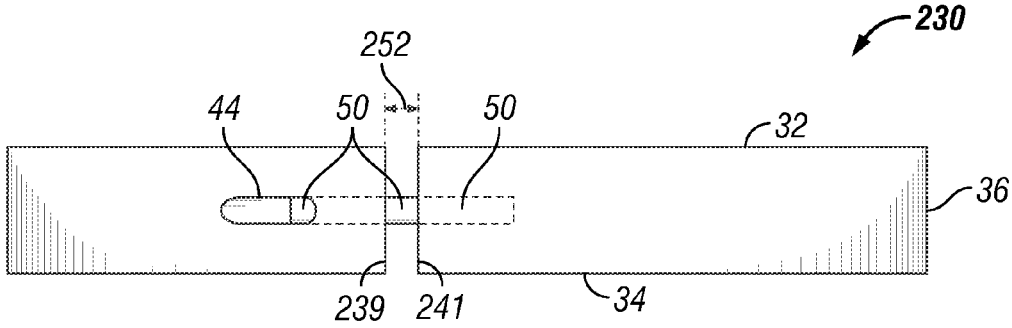
FIG. 7 is a side view of an additional embodiment of a radially expandable seat member shown in the first or collapsed position.

Alternatively, as shown in FIG. 7, first end 239 and second end 241 of radially expandable seat member 230 may be disposed such that gap 252 exists between first end 239 and second end 241 when radially expandable seat member 230 is in the first or collapsed position. In other words, first end 239 and second end 242 are not in contact with each other when radially expandable seat member 230 is in the first or collapsed position. Although having first end 239 not in contact with second end 241 may cause leakage through gap 252 of radially expandable seat member 230 depending on how the plug element contacts the seat of radially expandable seat member 230, it is to be understood that the leakage through gap 252 may not be detrimental to the operation of radially expandable seat member 230 to provide the necessary increase in pressure above radially expandable seat member 230 to actuate the downhole tool or otherwise perform a downhole operation and to cause shear screw 50 to fail so radially expandable seat member 230 can expand to its second or expanded position so the plug element can pass through radially expandable seat member 230.

To decrease the possibility that leakage will occur in the embodiment of any of radially expandable seat member 30 (FIGS. 1-5), radially expandable seat member 130 (FIG. 6), or radially expandable seat member 230 (FIG. 7), such that radially expandable seat member 30, radially expandable seat member 130, or radially expandable seat member 230, are unable to perform their intended functions, a bonding material such as an elastomer or polymer material may be disposed at, over, or within the area where first ends 39, 139, 239 and second ends 41, 141, 241, respectively, come together. In other words, even if first ends and second ends are in contact with each other such as shown with respect to radially expandable seat member 30 (FIGS. 1-5) and radially expandable seat member 130 (FIG. 6), a bonding material may be disposed at, over, or within the area of where first ends second ends come together. In addition, a bonding material may be disposed within gap 252 of radially expandable seat member 230.

Figure 8:
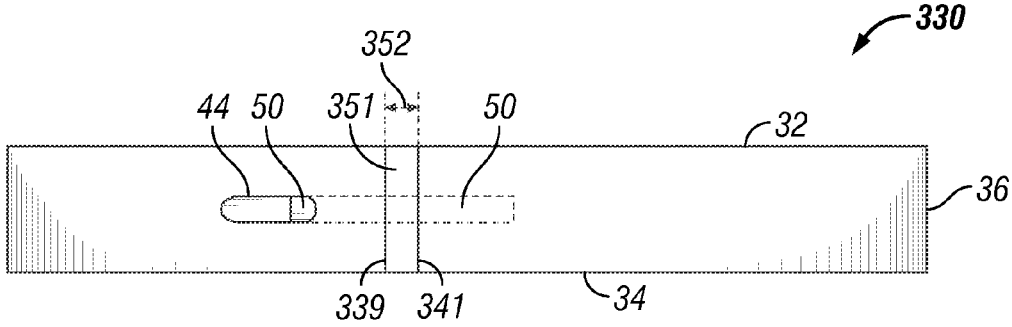
FIG. 8 is a side view of yet another specific embodiment of a radially expandable seat member shown in the first or collapsed position.

Referring now to FIG. 8, in another specific embodiment, radially expandable seat member 330 comprises first end 339 and second end 341 providing gap 352 when radially expandable seat member 330 is in the first or collapsed position (FIG. 8). Bonding material 351 is disposed within gap 352 to reduce the likelihood of leakage between first end 339 and second end 341 that would result in radially expandable seat member 330 being unable to perform its intended functions.

Although radially expandable seat member 30, radially expandable seat member 130, radially expandable seat member 230, and radially expandable seat member 330 are shown as having different structural arrangements, it is to be understood that radially expandable seat member 130, radially expandable seat member 230, and radially expandable seat member 330 all function in the same manner as described above with respect to radially expandable seat member 30 in FIGS. 1-5.

Figure 9:
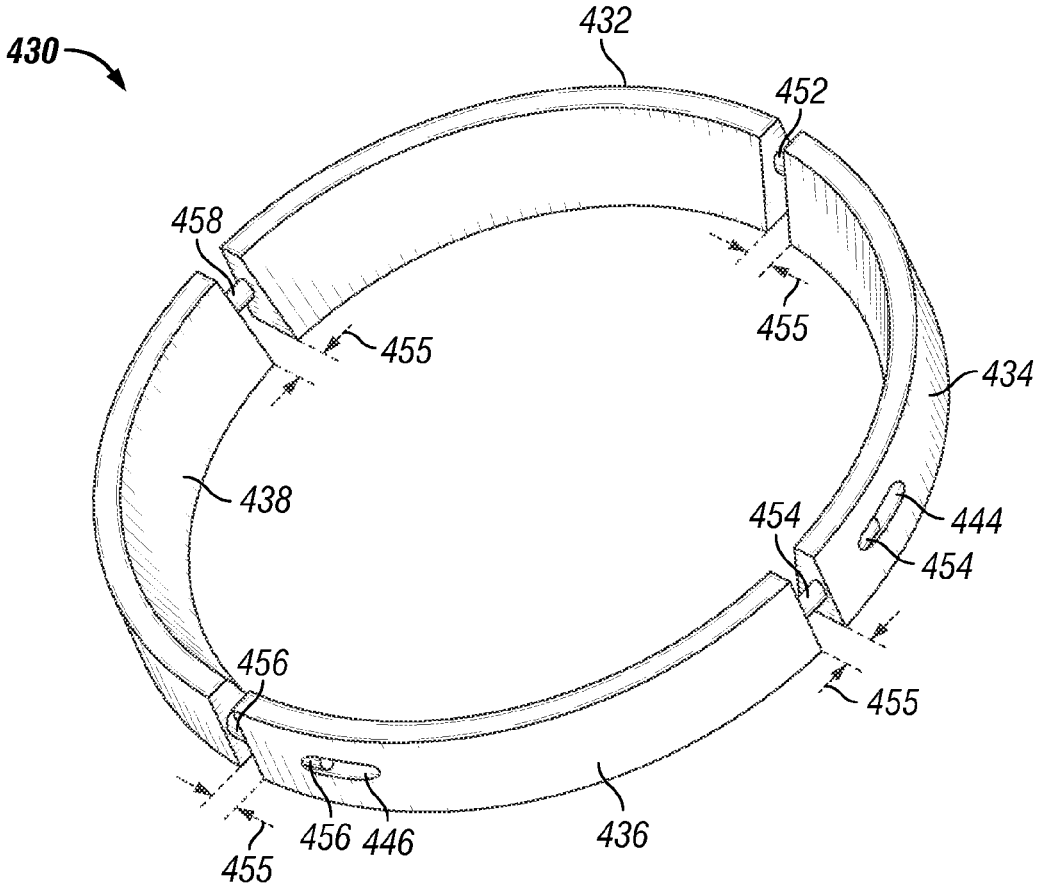
FIG. 9 is a perspective view of another specific embodiment of a radially expandable seat member shown in the first or collapsed position.

Referring now to FIG. 9, in another embodiment, radially expandable seat member 430 comprises the same general structures as those of radially expandable seat member 30 shown in FIGS. 1-5, however, radially expandable seat member 430 comprises four separate arcuate segments, 432, 434, 436, 438. Arcuate segment 432 is releasably connected to arcuate segment 434 through retaining member 452; arcuate segment 434 is releasably connected to arcuate segment 436 through retaining member 454; arcuate segment 436 is releasably connected to arcuate segment 438 through retaining member 456; and arcuate segment 438 is releasably connected to arcuate segment 432 through retaining member 458. Retaining members 452, 454, 456, 458 can be shear screws or any other retaining member that will fail under a predetermined condition, e.g., an increase in pressure. In addition, each of retaining members 452, 454, 456, 458 can be disposed in recesses disposed in the outer wall surfaces of separate arcuate segments 432, 434, 436, 438, such as shown in FIG. 9 with respect to retaining member 454 being disposed within recess 444 and retaining member 456 being disposed within recess 446.

As will be recognized by a person of ordinary skill in the art, the embodiment of FIG. 9 is not biased outwardly. In other words, radially expandable seat member 430 is not biased toward the second or expandable position. Thus, upon retaining members 452, 454, 456, 458 failing due to the increase in pressure above radially expandable seat member 430, each of arcuate segments 432, 434, 436, 438 is pushed into a recess disposed on an inner wall surface of a ball seat, such as recess 77 shown in FIGS. 3-5. As a result, the inner diameter between arcuate segments 432, 434, 436, 438 is enlarged allowing the plug element to pass through.

Figure 10:
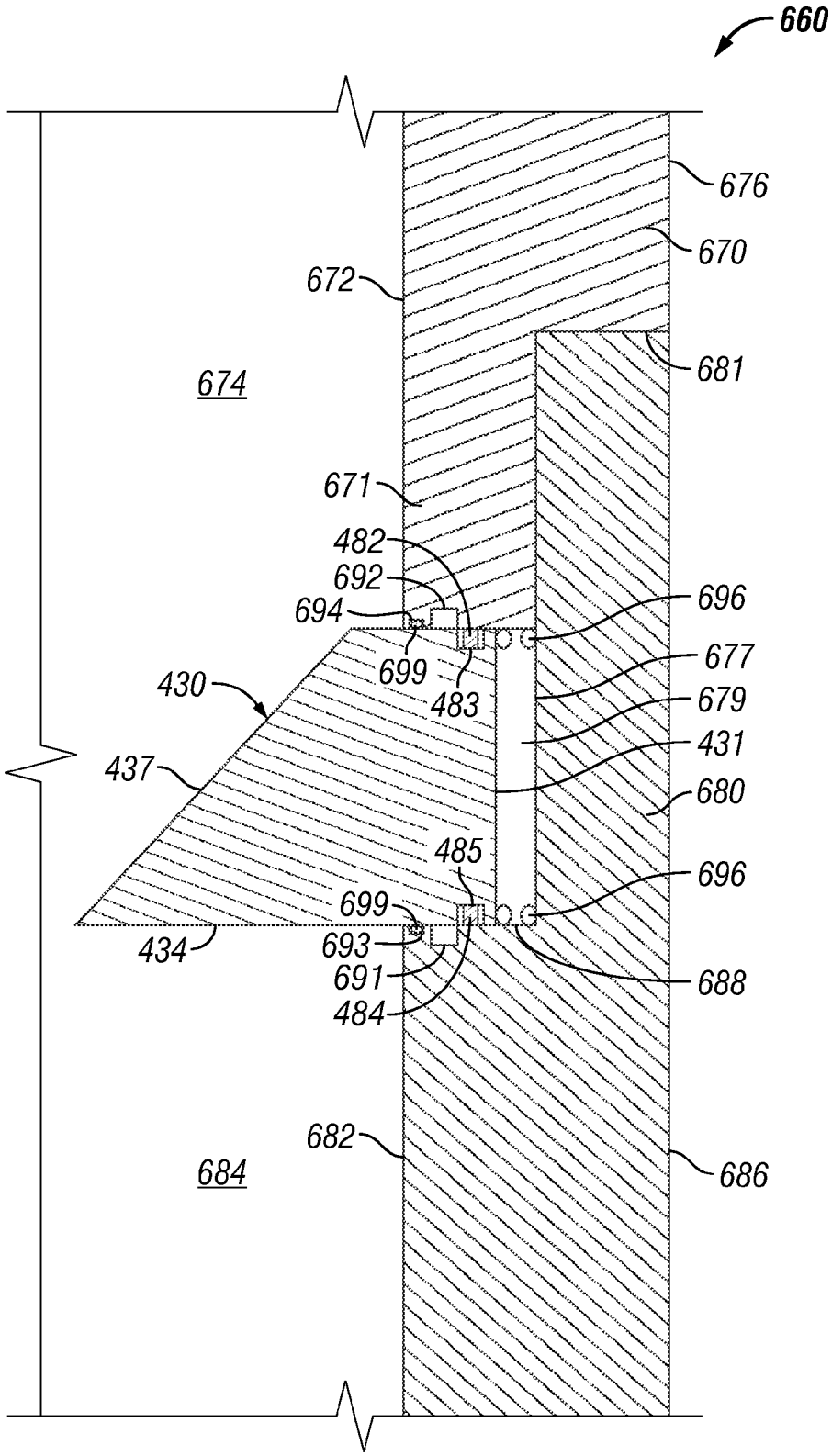
FIG. 10 is an enlarged cross-sectional view of a portion of a ball seat having the radially expandable seat member shown in FIG. 9 disposed therein, the radially expandable seat member being shown in the first or collapsed position.

Referring to FIG. 10, in one embodiment of a ball seat having radially expandable seat member 430 (FIG. 9), ball seat 660 comprises upper sub 670 and lower sub 680. Upper sub 670 comprises outer wall surface 676, lower end 671, and inner wall surface 672 defining upper sub bore 674. Lower sub 680 comprises upper end 681, outer wall surface 686, shoulder 688, and inner wall surface 682 defining lower sub bore 684.

Lower end 671 of upper sub 670 is connected to upper end 681 of lower sub 680 through any method or device known in the art such as threads (not shown). The make-up of upper sub 670 with lower sub 680 provides recess 677. Disposed within recess 677 is radially expandable seat member 430. Gap 679 is disposed between outer wall surface 431 of radially expandable seat member 430 and inner wall surface 682 of lower sub 680.

In the embodiment of FIG. 10, operatively associated with arcuate segment 434, as well as arcuate segments 432, 436, 438 (not shown in FIG. 10), is a locking mechanism that prevents arcuate segments 432, 434, 436, 438 from falling into lower sub bore 684 after retaining members 452, 454, 456, 458 release arcuate segments 432, 434, 436, 438. In the embodiment shown in FIG. 10, the locking mechanism comprises recess or groove 691 disposed in shoulder 688 of lower sub 680, recess or groove 692 disposed in lower end 671 of upper sub 670, upwardly biased member 482 disposed within groove 483 disposed on the upper surface of segment 434, downwardly biased member 484 disposed within groove 485 disposed on the lower surface of segment 434, and biased member 696 disposed within gap 679 and operatively associated with outer wall surface 431 of radially expandable seat member 430. Grooves 691, 692 are in fluid communication with recess 677. Upwardly and downwardly biased members 482, 484 can be separate components or they can comprise the same structure. In one embodiment, upwardly and downwardly biased members 482, 484 comprise a single c-ring structure. Biased member 696 is biased or energized inwardly toward bores 674, 684. When arcuate segments 432, 434, 436, 438 are held together by retaining members 452, 454, 456, 458, biased member 696 is unable to push segment 434 inwardly.

As further shown in FIG. 10, a second recess or groove 693 can be disposed in shoulder 688 of lower sub 680, and a second recess or groove 694 can disposed in lower end 671 of upper sub 670. O-rings or other seals 699 can be disposed in second groove 693 and second groove 694 to facilitate better sealing between the lower surface of arcuate segment 434 and shoulder 688 of lower sub 680 and between the upper surface of arcuate segment 434 and lower end 671 of upper sub 670.

In operation of ball seat 660 of FIG. 10, radially expandable seat member 430 is disposed in recess 677 in the first or collapsed position. Ball seat 660 is then placed in a work or tubing string and run-in a wellbore to a desired depth. A plug element is dropped down the bore of the tubing string until it enters upper sub bore 674 and lands on seat 437 of radially expandable seat member 430. Pressure is increased above radially expandable seat member 430 until a downhole tool is actuated or other downhole operation is performed. Thereafter, pressure is further increased until retaining members 452, 454, 456, 458 fail allowing the plug element to push arcuate segments 432, 434, 436, 438 radially outwardly. For example, as shown in FIG. 10, arcuate segment 434 can be pushed radially outwardly into recess 477. In so doing, biased member 696 becomes energized, or further energized. After the plug element passes through radially expandable seat member 430, biased member 696 pushes arcuate segment 434 inwardly toward bores 674, 684. Arcuate segment 434 is pushed inwardly by biased member 696 until groove 483 aligns with groove 692 and groove 485 aligns with groove 691 at which time upwardly and downwardly biased members 482, 484 expand upwardly and downwardly, respectively, into groove 692 and groove 691, respectively. In so doing, arcuate segment 434 becomes locked or retained within recess 677 so that arcuate segment 434 does not fall into lower sub bore 684.

Although the locking mechanism described above is described as being operatively associated with arcuate segment 434, it is to be understood that locking mechanisms, such as the one described above with respect to arcuate segment 434, may also be disposed on one more of arcuate segments 432, 436, 438. Alternatively, the locking mechanism may be omitted on all of arcuate segments 432, 434, 436, 438.

Figure 11:
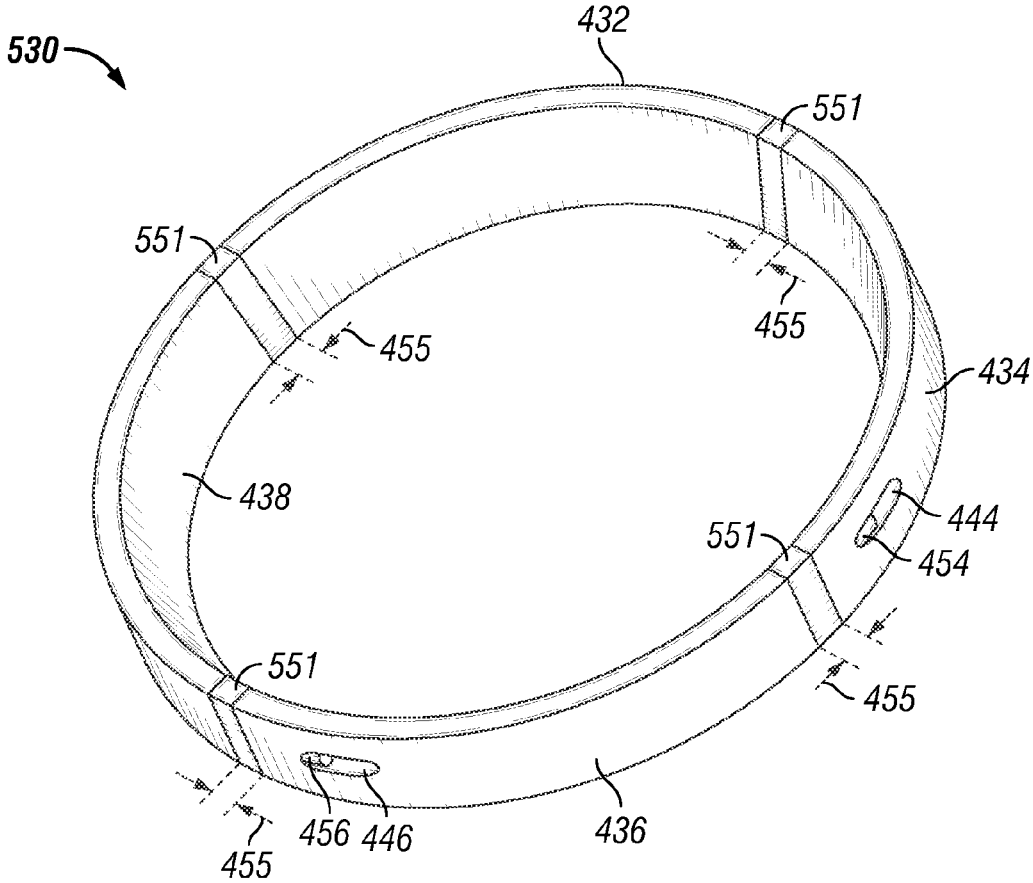
FIG. 11 is a perspective view of still another specific embodiment of a radially expandable seat member shown in the first or collapsed position.

Referring now to FIG. 11, in a modified embodiment of radially expandable seat member 430, radially expandable seat member 530 comprises bonding material 551 disposed in gaps 455 As discussed in greater detail above, bonding material 551 reduces leakage through gaps 455 so that radially expandable seat member 430 can performed its intended functions. Bonding material 551 may be any of the materials discussed above.

It is to be understood that the invention is not limited to the exact details of construction, operation, exact materials, or embodiments shown and described, as modifications and equivalents will be apparent to one skilled in the art. For example, the biased member can comprise a coiled spring, belleville spring (also known as belleville washers), a spiral spring, an elastomeric material, or the like. Further, the size of first and second inner diameter openings can be modified as necessary or desired based upon the size of the plug element. In addition, the first and second ends do not have to contact or otherwise engage one another when the radially expandable seat member is in its collapsed position.

Additionally, although the apparatuses described in greater detail with respect to FIGS. 1-11 are ball seats having a ball as their respective plug elements, it is to be understood that the apparatuses disclosed herein may be any type of seat known to persons of ordinary skill in the art that include a radially expandable seat member. For example, the apparatus may be a drop plug seat, wherein the drop plug temporarily restricts the flow of fluid through the wellbore. Therefore, the terms "plug" and "plug element" as used herein encompasses a ball as shown and discussed with respect to the embodiments of the Figures, as well as any other type of device that is used to restrict the flow of fluid through a seat. Further, in all of the embodiments discussed with respect to FIGS. 1-11, upward, toward the surface of the well (not shown), is toward the top of FIGS. 1-11, and downward or downhole (the direction going away from the surface of the well) is toward the bottom of FIGS. 1-11. However, it is to be understood that the seats may have their positions rotated. Accordingly, the ball seats can be used in any number of orientations easily determinable and adaptable to persons of ordinary skill in the art. Accordingly, the invention is therefore to be limited only by the scope of the appended claims.

What is claimed is:

1. An apparatus for restricting flow through a conduit, the apparatus comprising:

a housing having a longitudinal bore and a radially expandable seat member disposed within the bore, the radially expandable seat member having a first position for receiving a plug element to restrict fluid flow through the longitudinal bore and a second position in which the plug element passes through the radially expandable seat member, the radially expandable seat member comprising an arcuate member comprising a first end and a second end, the first and second ends being disposed relative to each other for receiving the plug element when the radially expandable seat member is in the first position, and a retaining member operatively associated with the first and second ends to retain the radially expandable seat member in the first position, the retaining member comprising a retained position in which the radially expandable seat member is retained in the first position and a released position in which the first end and second end are released from the retaining member allowing the radially expandable seat member to radially expand to the second position, wherein the retaining member is disposed partially within the first end and partially within the second end to releasably connect the first end to the second end.

2. The apparatus of claim 1, wherein the radially expandable seat member is biased toward the second position.

3. The apparatus of claim 1, further comprising a biased member, the biased member comprising a c-ring.

4. The apparatus of claim 1, wherein the radially expandable seat member comprises an outer wall surface, the outer wall surface having a recess disposed therein for receiving the retaining member.

5. The apparatus of claim 4, wherein the retaining member is a shear screw.

6. The apparatus of claim 1, wherein the first and second ends are in contact with each other when the retaining member is in the retained position.

7. The apparatus of claim 6, wherein the first end comprises a first inclined surface and the second end comprises a second inclined surface, the first and second inclined surfaces being in sliding engagement with each other.

8. The apparatus of claim 1, wherein a gap is disposed between the first and second ends when the retaining member is in the retained position.

9. The apparatus of claim 8, wherein a bonding material is disposed within the gap.

10. The apparatus of claim 1, wherein a bonding material is disposed at the first and second ends when the retaining member is in the retained position.

11. An apparatus for restricting flow through a conduit, the apparatus comprising:

a housing having a longitudinal bore and a radially expandable seat member disposed within the bore, the radially expandable seat member having a first position for receiving a plug element to restrict fluid flow through the longitudinal bore and a second position in which the plug element passes through the radially expandable seat member, the radially expandable seat member comprising a plurality of arcuate segments, each arcuate segment being releasably connected to an adjacent arcuate segment by a retaining member operatively associated with the adjacent arcuate segments, each of the retaining members retaining the radially expandable seat member in the first position, each of the retaining members comprising a retained position in which the radially expandable seat member is retained in the first position and a released position in which the arcuate segments are released from the retaining members allowing the radially expandable seat member to radially expand to the second position.

12. The apparatus of claim 11, wherein two or more of the plurality of arcuate segments are in contact with each other when the retaining members are in the retained position.

13. The apparatus of claim 11, wherein a gap is disposed between one or more of the arcuate members when the retaining member is in the retained position.

14. The apparatus of claim 13, wherein a bonding material is disposed within the gap.

15. The apparatus of claim 11, wherein the radially expandable seat member is disposed in sliding engagement within a recess disposed on an inner wall surface of the housing, the recess providing a gap between the radially expandable seat member and the inner wall surface of the housing when the radially expandable seat member is in the first position, the gap providing an area for the radially expandable seat member to radially expand within the recess.

16. The apparatus of claim 15, wherein at least one of the plurality of arcuate segments is operatively associated with a locking mechanism for locking the each of the at least one of the plurality of arcuate segments within the recess when the radially expandable seat member is in the second position.

17. The apparatus of claim 16, wherein the locking mechanism comprises an arcuate segment upper groove disposed in an arcuate segment upper surface, an upper recess groove disposed in an upper surface of the recess, and a first locking member disposed in the arcuate segment upper groove, the upper recess groove being disposed inwardly relative to the arcuate segment upper groove when the radially expandable seat member is in the first position, wherein inward movement of the at least one of the plurality of arcuate segments comprising the locking mechanism toward the second position causes the first locking member to become partially disposed within the upper recess groove thereby preventing additional inward movement of the at least one of the plurality of arcuate segments comprising the locking mechanism.

18. The apparatus of claim 17, wherein an inwardly biased member is disposed in the gap, the inwardly biased member urging the at least one of the plurality of arcuate segments comprising the locking mechanism toward the second position.

19. The apparatus of claim 18, wherein the locking mechanism further comprises an arcuate segment lower groove disposed in an arcuate segment lower surface, a lower recess groove disposed in a lower surface of the recess, and a second locking member disposed in the arcuate segment lower groove, the lower recess groove being disposed inwardly relative to the arcuate segment lower groove when the radially expandable seat member is in the first position, wherein inward movement of the at least one of the plurality of arcuate segments comprising the locking mechanism toward the second position causes the second locking member to become partially disposed within the lower recess groove thereby preventing additional inward movement of the at least one of the plurality of arcuate segments comprising, the locking mechanism.

20. The apparatus of claim 19, wherein the first locking member and the second locking member comprise a c-ring.

21. The apparatus of claim 11, wherein a bonding material is disposed between each of the plurality of arcuate segments.

22. The apparatus of claim 11, wherein each of the plurality of arcuate segments is disposed within a groove disposed on an inner wall surface of the longitudinal bore, each of the plurality of arcuate segments comprising an upper surface and a lower surface, each of the upper surfaces being in sealing engagement with an upper wall surface of the groove and each of the lower surfaces being in sealing engagement with a lower wall surface of the groove.

* * * * *